US006729439B1

(12) United States Patent
Zlatis et al.

(10) Patent No.: US 6,729,439 B1
(45) Date of Patent: May 4, 2004

(54) TOOL SUPPORT ATTACHMENT FOR A LADDER

(76) Inventors: Antonios Zlatis, 2894 Bailey Ave., Bronx, NY (US) 10463; Georgio Haliotis, 378 90$^{th}$ St., Brooklyn, NY (US) 11209

( * ) Notice: Subject to any disclaimer, the term of this patent is extended or adjusted under 35 U.S.C. 154(b) by 0 days.

(21) Appl. No.: 10/378,153

(22) Filed: Mar. 4, 2003

(51) Int. Cl.$^{7}$ ..... E04G 1/00; E06C 7/14; A47G 21/14; A47F 7/00

(52) U.S. Cl. ..... 182/129; 206/373; 248/210; 248/238; 248/37.6; 211/70.6

(58) Field of Search ..... 182/129, 107, 182/230, 214, 45; 206/372, 373; 248/210, 211, 238, 37.3, 37.6; 211/65, 70.6; 220/694, 697

(56) References Cited

U.S. PATENT DOCUMENTS

| | | | | | |
|---|---|---|---|---|---|
| 676,573 | A | * | 6/1901 | Bowers | 211/70.6 |
| 1,188,791 | A | * | 6/1916 | Knechtel | 211/70.6 |
| 3,077,977 | A | * | 2/1963 | Wood | 211/70.6 |
| 3,422,923 | A | * | 1/1969 | Lund | 182/129 |
| 4,300,740 | A | * | 11/1981 | Killian | 248/238 |
| 4,356,916 | A | | 11/1982 | Anglemyer | |
| 5,005,710 | A | | 4/1991 | Hofer | |
| 5,046,623 | A | * | 9/1991 | Takacs | 211/65 |
| 5,052,581 | A | | 10/1991 | Christ et al. | |
| D322,163 | S | | 12/1991 | Shu | |
| 5,419,409 | A | * | 5/1995 | Corulla | 182/129 |
| 5,511,753 | A | * | 4/1996 | Lage | 248/238 |
| 5,562,208 | A | * | 10/1996 | Hasler et al. | 206/373 |
| 5,613,574 | A | | 3/1997 | Melanson | |
| 5,743,416 | A | * | 4/1998 | Yemini | 211/70.6 |
| 5,843,388 | A | * | 12/1998 | Arroyo et al. | 211/70.6 |
| 5,915,573 | A | | 6/1999 | Drower et al. | |
| 5,971,102 | A | * | 10/1999 | Brown | 182/129 |
| 6,032,796 | A | * | 3/2000 | Hopper et al. | 206/377 |
| 6,443,260 | B1 | * | 9/2002 | Katz et al. | 182/129 |
| 6,502,664 | B1 | * | 1/2003 | Peaker, Sr. | 182/129 |

* cited by examiner

*Primary Examiner*—Hugh B. Thompson, II

(57) ABSTRACT

A tool support attachment for a ladder for supporting carpentry and building tools upon a ladder. The tool support attachment for a ladder includes two panels having first and second side edges and also having a plurality of elongate tool-mounting slots being disposed through the second side edges and being extended in the panel for supporting carpentry and building tools; and also includes clip members being pivotally attached to front edges of the panels for removably and securely attaching the panels to the ladder; and further includes tool retainer members being attached to the panels to prevent the carpentry and building tools from slipping out of the panels.

8 Claims, 3 Drawing Sheets

TOOL SUPPORT ATTACHMENT FOR A LADDER

BACKGROUND OF THE INVENTION

1. Field of the Invention

The present invention relates to tool supports for ladders and more particularly pertains to a new tool support attachment for a ladder for supporting carpentry and building tools upon a ladder.

2. Description of the Prior Art

The use of tool supports for ladders is known in the prior art. More specifically, tool supports for ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,356,916; U.S. Pat. No. 5,005,710; U.S. Pat. No. 5,915,573; U.S. Pat. No. 5,613,574; U.S. Pat. No. 5,052,581; and U.S. Pat. No. Des. 322,163.

While these devices fulfill their respective, particular objectives and requirements, the aforementioned patents do not disclose a new tool support attachment for a ladder. The prior art includes tool holders which are blocks that are fastened with fasteners to building structures.

SUMMARY OF THE INVENTION

The general purpose of the present invention, which will be described subsequently in greater detail, is to provide a new tool support attachment for a ladder which has many of the advantages of the tool supports for ladders mentioned heretofore and many novel features that result in a new tool support attachment for a ladder which is not anticipated, rendered obvious, suggested, or even implied by any of the prior art tool supports for ladders, either alone or in any combination thereof. The present invention includes two panels having first and second side edges and also having a plurality of elongate tool-mounting slots being disposed through the second side edges and being extended in the panel for supporting carpentry and building tools; and also includes clip members being pivotally attached to front edges of the panels for removably and securely attaching the panels to the ladder; and further includes tool retainer members being attached to the panels to prevent the carpentry and building tools from slipping out of the panels. None of the prior art includes the combination of the elements of the present invention.

There has thus been outlined, rather broadly, the more important features of the tool support attachment for a ladder in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new tool support attachment for a ladder which has many of the advantages of the tool supports for ladders mentioned heretofore and many novel features that result in a new tool support attachment for a ladder which is not anticipated, rendered obvious, suggested, or even implied by any of the prior art tool supports for ladders, either alone or in any combination thereof.

Still another object of the present invention is to provide a new tool support attachment for a ladder for supporting carpentry and building tools upon a ladder.

Still yet another object of the present invention is to provide a new tool support attachment for a ladder that is easy and convenient to set up and use.

Even still another object of the present invention is to provide a new tool support attachment for a ladder that allows the user to keep one's needed tools close by while being on the ladder rather than the user having to continually climb on and off the ladder to retrieve one's tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
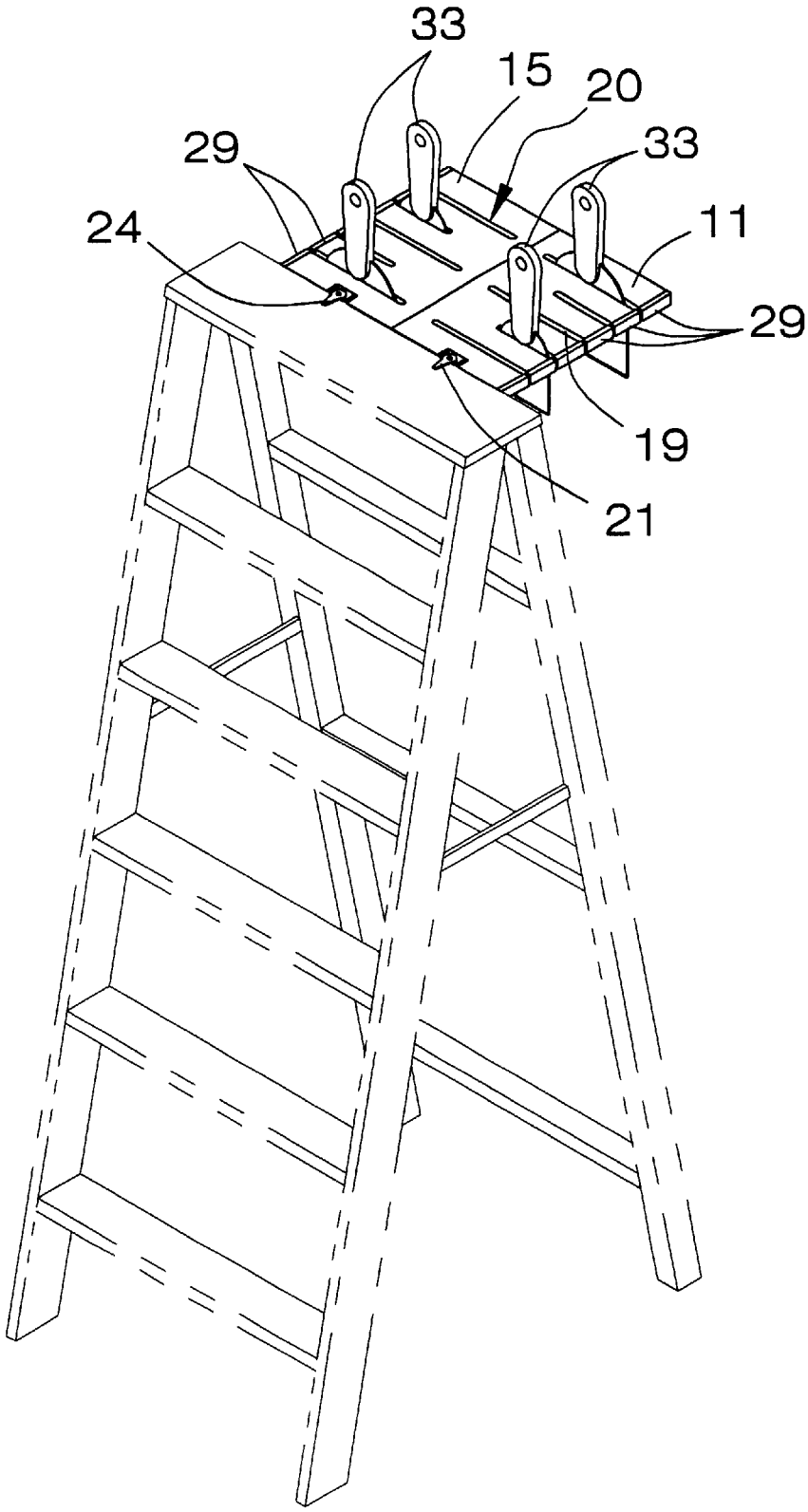
FIG. 1 is a perspective view of a new tool support attachment for a ladder according to the present invention.
Figure 2:
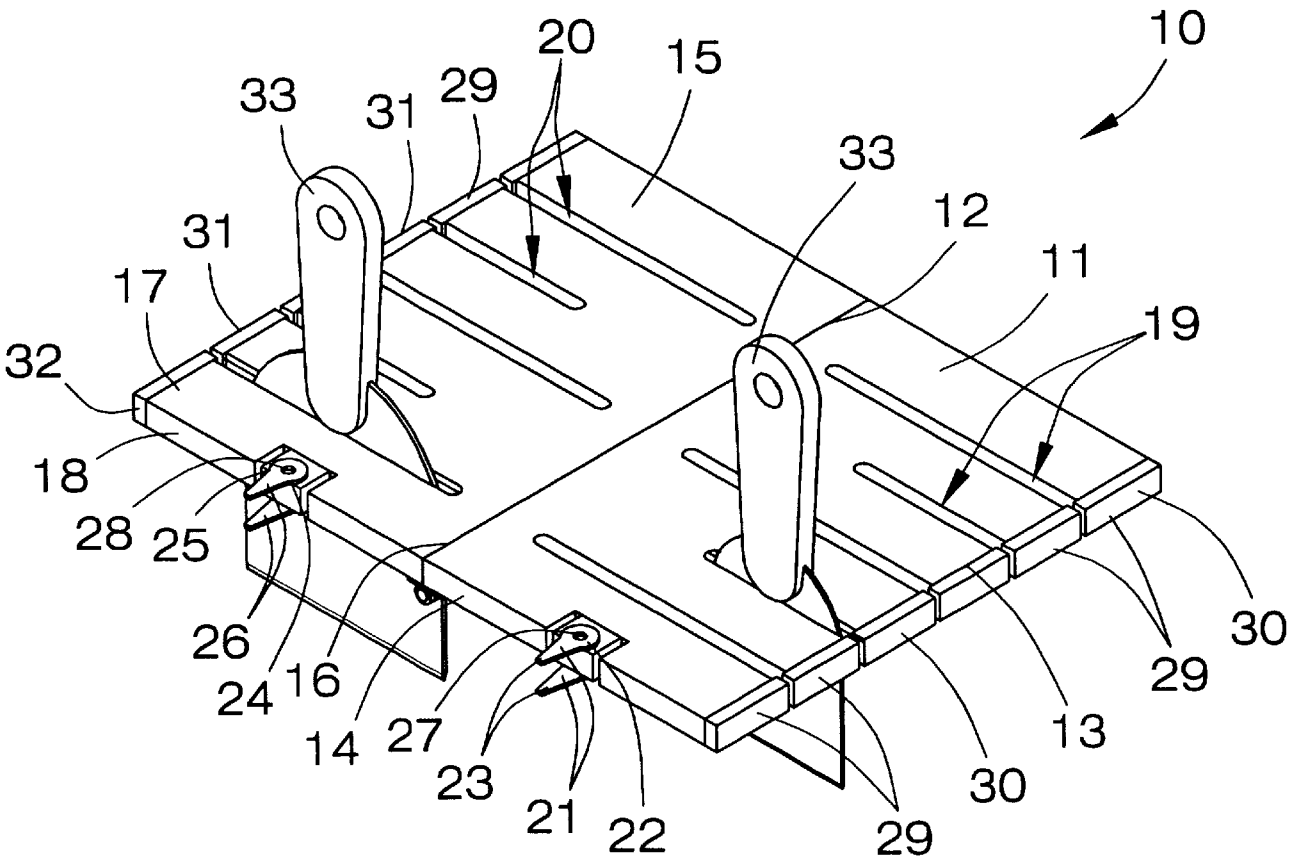
FIG. 2 is another perspective view of the present invention.
Figure 3:
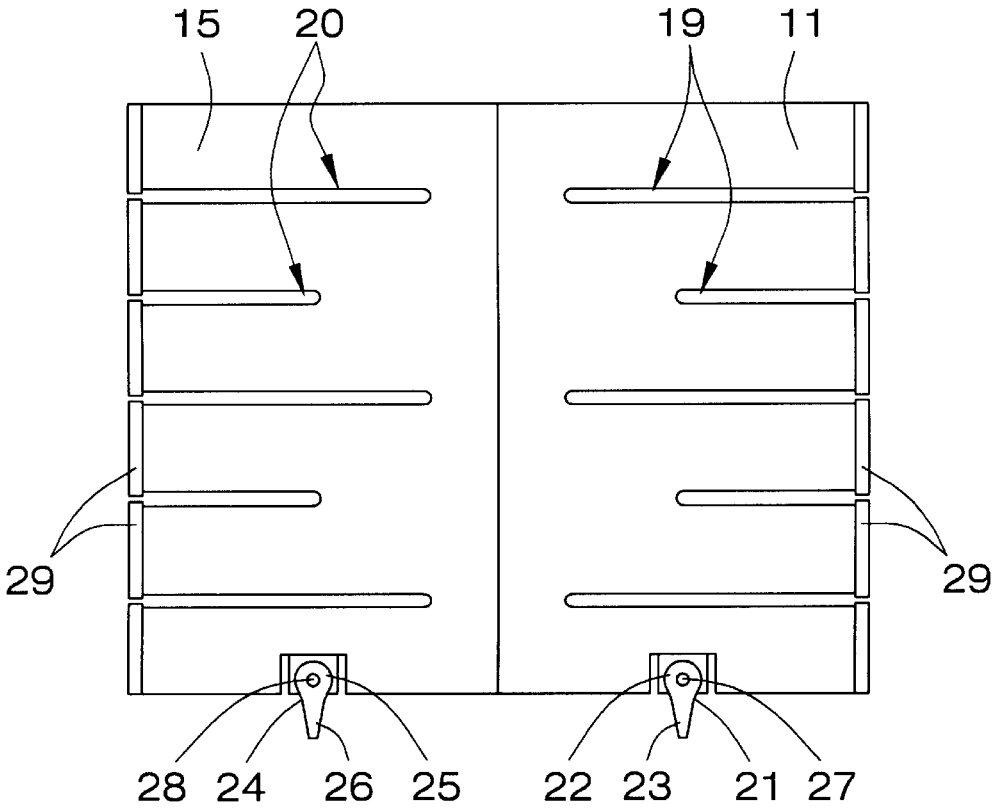
FIG. 3 is a top plan view of the present invention.
Figure 4:
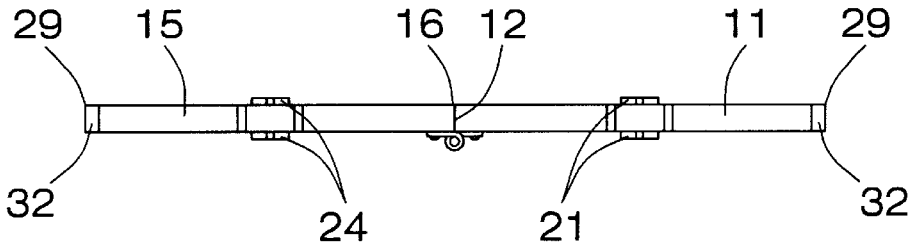
FIG. 4 is a side edge elevational view of the present invention.

With reference now to the drawings, and in particular to FIGS. 1 through 4 thereof, a new tool support attachment for a ladder embodying the principles and concepts of the present invention and generally designated by the reference numeral 10 will be described.

As best illustrated in FIGS. 1 through 4, the tool support attachment for a ladder 10 generally comprises two panels 11,15 having first and second side edges 12,13,16,17 and also having a plurality of elongate tool-mounting slots 19,20 being disposed through the second side edges 13,17 and being extended in the panels 11,15 for supporting carpentry and building tools 33. The first side edges 12,16 of the panels 11,15 are hingedly and conventionally attached to one another with the panels 11,15 being foldable upon one another for storage. The elongate tool-mounting slots 19,20 of each panel 11,15 are disposed parallel to one another and are spacedly disposed and extended through the second side edge 13,17 of a respective panel 11,15. The elongate tool-mounting slots 19,20 have variable lengths and extend selected distances inwardly of the panels 11,15 to accommodate and support various sized carpentry and building tools 33.

Clip members are pivotally and conventionally attached to front edges 14,18 of the panels 11,15 for removably and securely attaching the panels 11,15 to the ladder. Each of the clip members includes pairs of finger members 21,24 with each pair of the finger members 21,24 having one of the finger members 21,24 being pivotally and conventionally attached to a first side and at the front edge 11,18 of a respective panel 11,15 and also having the other of the finger members 21,24 being pivotally and conventionally attached to a second side and at the front edge 14,18 of a respective panel 11,15. Each pair of the finger members 21,24 is adapted to receive an edge portion of a step of the ladder therebetween. The finger members 21,24 of each pair of the finger members 21,24 are spacedly aligned to one another. Each of the finger members 21,24 has a rounded first end portion 22,25 which is pivotally attached with a fastener 27,28 to a respective panel 11,15, and also has a tapered second end portion 23,26 which extends outwardly beyond the front edge 14,18 of a respective panel 11,15 and which is adapted to engage about a portion of the step of the ladder.

Tool retainer members 29 are conventionally attached to the panels 11,15 to prevent the carpentry and building tools 33 from slipping out of the panels 11,15. The tool retainer members 29 includes elongate rubber endcaps being engaged to the second side edges 13,17 of the panels 11,15 between the elongate tool-mounting slots 19,20. Each of the elongate rubber endcaps includes a main wall 30 and also includes side and end walls 31,32 which are angled relative to the main wall 30 and which engage about portions of the second side edge 13,17 of a respective panel 11,15.

In use, the user clips the fingers members 21,24 to preferably the top step of the ladder with the panels 11,15 being disposed generally outwardly from the step, and the user slips the needed carpentry and building tools 33 in the elongate tool-mounting slots 19,20, and while the user is working upon he ladder, the user has immediate access to all of one's tools 33. When finished, the user simply removes the tools 33 and unclips the finger members 21,24 from the step and folds the panels 11,15 onto one another for easy storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the tool support attachment for a ladder. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tool support attachment for a ladder comprising:

two panels having first and second side edges and also having a plurality of elongate tool-mounting slots being disposed through said second side edges and being extended in said panels for supporting carpentry and building tools;

clip members being pivotally attached to front edges of said panels for removably and securely attaching said panels to the ladder; and tool retainer members being attached to said panels to prevent the carpentry and building tools from slipping out of said panels.

2. The tool support attachment for a ladder as described in claim 1, wherein said first side edges of said panels are hingedly attached to one another with said panels being foldable upon one another for storage.

3. The tool support attachment for a ladder as described in claim 2, wherein said elongate tool-mounting slots of each said panel are disposed parallel to one another and are spacedly disposed and extended through said second side edge of a respective said panel.

4. The tool support attachment for a ladder as described in claim 3, wherein said elongate tool-mounting slots have variable lengths and extend selected distances inwardly of said panels to accommodate and support various sized carpentry and building tools.

5. The tool support attachment for a ladder as described in claim 4, wherein each of said clip members includes pairs of finger members with each said pair of said finger members having one of said finger members being pivotally attached to a first side and at said front edge of a respective said panel and also having the other of said finger members being pivotally attached to a second side and at said front edge of a respective said panel, each said pair of said finger members being adapted to receive an edge portion of a step of the ladder therebetween, said finger members of each said pair of said finger members being spacedly aligned to one another.

6. The tool support attachment for a ladder as described in claim 5, wherein each of said finger members has a rounded first end portion which is pivotally attached with a fastener to a respective said panel, and also has a tapered second end portion which extends outwardly beyond said front edge of a respective said panel and being adapted to engage about a portion of the step of the ladder.

7. The tool support attachment for a ladder as described in claim 6, wherein said tool retainer members includes elongate rubber endcaps being engaged to said second side edges of said panels between said elongate tool-mounting slots.

8. The tool support attachment for a ladder as described in claim 7, wherein each of said elongate rubber endcaps includes a main wall and also includes side and end walls which are angled relative to said main wall and which engage about portions of said second side edge of a respective said panel.

* * * * *